US006003239A

United States Patent [19]

Liebenthal et al.

[11] Patent Number: 6,003,239

[45] Date of Patent: Dec. 21, 1999

[54] ELECTRICALLY POWERED DEVICE FOR TREATMENT OF HAIR

[75] Inventors: Dieter Liebenthal, Maintal; Jürgen Behrendt, Idstein, both of Germany; Ralf Dorber, Barcelona, Spain; Peter Janouch, Linsengericht, Germany

[73] Assignee: Braun Gesellschaft mit beschraenkter Haftung (GmbH), Germany

[21] Appl. No.: 08/914,561

[22] Filed: Aug. 19, 1997

[30] Foreign Application Priority Data

Aug. 26, 1996 [DE] Germany ..... 196 34 423

[51] Int. Cl.[6] ..... A45D 1/00

[52] U.S. Cl. ..... 34/97

[58] Field of Search ..... 34/90, 96, 97, 34/98, 99, 100; 392/380, 383, 384, 385; 132/271, 129

[56] References Cited

U.S. PATENT DOCUMENTS

| | | | |
|---|---|---|---|
| 4,605,019 | 8/1986 | Reynolds | 132/272 |
| 4,664,132 | 5/1987 | Schillig | 132/11 |
| 4,864,735 | 9/1989 | Chung | 34/90 |
| 4,936,027 | 6/1990 | Tsuji | 34/90 |
| 4,972,065 | 11/1990 | Ohlsen | 392/380 |
| 5,592,749 | 1/1997 | Trimmer | 34/97 |
| 5,628,123 | 5/1997 | Chan | 34/90 |
| 5,701,681 | 12/1997 | Wonka et al. | 34/97 |

FOREIGN PATENT DOCUMENTS

| | | | |
|---|---|---|---|
| 28 04 820 | 8/1979 | Germany | A45D 20/50 |
| 83 17 832 | 6/1985 | Germany | A45D 20/08 |
| 39 04 860 | 8/1990 | Germany | A45D 20/12 |
| 93 05 195 | 7/1993 | Germany | A45D 20/12 |
| 64-72706 | 3/1989 | Japan | A45D 20/12 |
| 7-51117 | 2/1995 | Japan | A45D 2/36 |
| 2533745 | 6/1996 | Japan | A45D 2/36 |
| 9-37833 | 2/1997 | Japan | A45D 4/16 |
| 841147 | 7/1960 | United Kingdom . | |
| 1346399 | 2/1974 | United Kingdom | A45D 20/48 |

*Primary Examiner*—Henry Bennett
*Assistant Examiner*—Steve Gravini
*Attorney, Agent, or Firm*—Edward S. Podszus

[57] ABSTRACT

The invention is directed to an electrically powered device for the treatment of hair, in particular for the styling and/or drying of hair. This device is equipped with a first adapter element, for example, a plug-and-socket element, for connecting, in particular electrically, the device with an additional electrically powered device for the treatment of hair, which includes a second adapter element. In this arrangement, the first and second adapter elements include differentiating elements, in particular geometrical differentiating features, which are designed such that exclusively two devices equipped with corresponding differentiating elements are connectable with each other. The two connectable devices may be a hair dryer and an additional implement for a hair dryer, for example.

18 Claims, 7 Drawing Sheets

ELECTRICALLY POWERED DEVICE FOR TREATMENT OF HAIR

This invention relates to an electrically powered device for the treatment of hair, in particular for the styling and/or drying of hair. This device includes a first adapter element, for example, a plug-and-socket element, which is intended to connect, in particular electrically, the device with an additional electrically powered device for the treatment of hair which includes a second adapter element.

Devices of this type are known in the art. Thus, JP 7-51117 describes a curling iron with a handle member and an accessory. Accommodated in the handle member are a fan and a heater unit. The accessory, for example, a round brush, contains further electric components and is connectable with the air outlet end of the handle member by electrical connecting means.

In the known devices, no particular importance has been heretofore attached to the configuration of the adapter elements between the two devices, for example, between a handle member and a brush attachment.

It is thus possible for any implement to be exchanged for another implement freely and unhindered for use with the same handle member. However, the case may occur that an implement containing, for example, a 6 volt motor fits on a hair dryer in which an electric voltage of 220 volts is applied to its adapter element, which may cause damage to or failure of the motor in the implement, in addition to presenting a hazard for its user.

It is accordingly an object of the present invention to provide an electrically powered device for the treatment of hair, in particular for the styling and/or drying of hair, for example a hair dryer, which includes means ensuring that the hair dryer accommodates exclusively a specific and electrically powered device for treating hair, for example, an additional implement. The purpose of this is in particular to prevent an electrically powered additional implement which requires a defined electric voltage from being connectable with a hair dryer which has a different electric voltage applied to its adapter element.

According to the present invention, this object is accomplished in that in an electrically powered device for the treatment of hair, in particular for the styling and/or drying of hair, which incorporates the above-described features, the first and second adapter elements include differentiating means, in particular geometrical differentiating means, which are configured such that exclusively two specific devices, for example, a hair dryer and an additional implement, equipped with corresponding differentiating means are connectable with each other.

The advantage thereby achieved is that an additional implement is not connectable with a hair dryer when the implement and the hair dryer are not intended for joint use. Still further, it can be thereby prevented that an implement requiring, for example, an electric voltage of 6 volts for operation, can be attached to a hair dryer which has line voltage, for example 220 volts, residing at its electric adapter element. This precludes damage to or destruction of the additional implement on the one hand, and also a hazard for the user on the other hand.

In a particular further feature of the present invention, the first adapter element includes at least one electrical conductor for connection with the electrics of the device as, for example, the hair dryer, and a housing having at least one individually shaped housing section. This housing section is shaped so as to correspond with the second adapter element on the additional device as, for example, the additional implement. The advantage thereby achieved is that the adapter elements are easily and effectively recognized as being different by simple means, that is, by an individually shaped housing section of the adapter element, as a result of which only devices having corresponding differentiating means can be connected with each other.

In a particular configuration of the present invention, the electrically powered device for the treatment of hair is a hair dryer having a fan motor producing an air current, a heater unit for heating the air current, and a housing with an air inlet port and an air outlet port. This advantageously enables the hair dryer to be equipped with adapter elements which permit utilization of the dryer with an attachment, for example, an additional implement, which includes differentiating means that correspond with the first adapter element on the hair dryer.

Alternatively, the electrically powered device may be an implement for the treatment of hair, in particular an additional implement for the styling and/or drying of hair, which is attachable to the air outlet port of the hair dryer and contains an electrical load as, for example, an electric motor. Advantageously, this enables also the implement to be provided with such differentiating means that enable a connection specifically with a hair dryer having a corresponding differentiating means. By configuring the device for hair treatment as a hair dryer or as an additional implement, exclusively those devices can be combined which are connectable with each other by the user. Thus, for example, an implement having a defined flow resistance can be combined exclusively with a hair dryer predetermined by the manufacturer of the devices in order to thus preclude potential overheating of the implement. On the other hand, destruction of the electrical components of the additional implement can also be avoided to advantage in cases where the additional implement is attached to a hair dryer which has a higher electric voltage residing at its adapter element than is necessary for operation of the implement.

In a further feature of the present invention, it is proposed providing a plug element on the implement and a corresponding socket element on the hair dryer. It will be an advantage to provide the socket element on the hair dryer because it is conventionally less susceptible to damage than a plug element. As an alternative, the arrangement may also be reversed, meaning that the plug element is on the hair dryer and the corresponding socket element is arranged on the implement should this be necessary for technical, in particular design reasons.

In a particular further feature, the adapter element is disposed on the inside of the hair dryer housing. This has the advantage of avoiding a change of form on the outside of the hair dryer housing. The housing's forward parts for different hair dryers are advantageously alike for different types of device.

As an alternative, it is also possible for an adapter element to be disposed on the outside of the hair dryer housing. This has the advantage of avoiding a variation of the area of cross-section of the hair dryer's air outlet port, and the air stream exiting from the dryer is not adversely affected.

In a further feature of the electrical device, the in particular elongate housing of the adapter element is arranged on the housing of a hair dryer substantially parallel or, alternatively, normal to the direction of main flow. As a result, the end face of the adapter element can terminate substantially flush with the air outlet end of the dryer housing. On the other hand, with a parallel arrangement, a simple connection of an additional implement with the dryer housing is possible, while a vertical arrangement also makes provision for a bayonet catch.

In a particularly advantageous further feature of the present invention, the housing of the adapter element is mountable on the housing of the hair dryer as, for example, by locking or snap-fitting engagement therewith. This enables the selection of one type of housing from a series of different types of housing of the adapter element for a hair dryer housing, in addition to proposing ease of assembly.

In a particular configuration, the housings of the adapter elements have guiding surfaces on their longitudinal sides. Particularly when the adapter elements are aligned parallel to the direction of main flow of the dryer housing, a reliable guiding between the two adapter elements is thereby proposed as soon as the two adapter elements are connected with each other in a direction parallel to the direction of main flow of the device.

In a particular configuration, the adapter elements include a respective housing of a constant cross-sectional profile at least in sections thereof, and the profiles of the adapter elements on the hair dryer and on the implement are executed in corresponding fashion. This has the advantage of enabling the housings of different adapter elements to be essentially similar, providing only in sections thereof a cross-sectional profile which distinguishes one housing from the other. The section of the housing with the individual cross-sectional profile is advantageously arranged in the direction of the corresponding device, so that the two adapter elements with their two profiled housing sections point towards each other.

In a particular further feature, a housing part of an adapter element is slidably arranged, in particular the implement includes a slide or rotary switch disposed so as to be adjustable parallel or normal to the direction of main flow. This housing part enables a mechanical and/or an electrical connection to be established between the hair dryer and the implement. Advantageously, therefore, an implement can be seated on the air outlet port of a hair dryer by means of a bayonet catch known per se. Subsequently, by sliding the housing part of the one adapter element on the implement, the connection between the implement and the hair dryer is locked mechanically, in addition to an electrical connection being established between the two components.

In a particular configuration of an adapter element, in particular the element on the hair dryer, the housing of the adapter element has an essentially polygonal, closed area of cross-section. One side of the housing, particularly the rear side close to the hair dryer housing, has advantageously a form conforming essentially to the outer form of the hair dryer housing. The remaining outsides of the housing form, for example, a square cross-sectional area, with beveled or radiused edges being possible. Further, the sides of the housing may be of a concave, convex or similar form or be provided with nose-type protuberances of different size or in different quantities or disposed at different locations, with the advantage that the provision of a plurality of differently profiled cross-sectional areas is possible.

The slide switch is an adapter element corresponding with the just described housing and has a longitudinal side open, the switch having an in particular U-shaped cross-sectional area. Advantageously, a form for the switch slide is thus proposed which corresponds with the essentially polygonal closed cross-sectional area of the housing of the first adapter element, that is, the outside contour of the polygonal housing corresponds to the inside contour of the slide switch. Moreover, the contact pins and/or contact slots may be provided in the open area of the longitudinal side of the slide switch.

Advantageously, the slide switch is configured such as to be slidable onto the housing of the corresponding adapter element. This results in a rectilinear, simple and safe connection of the slide switch with the corresponding housing, enabling finger control by its user.

The housing of the adapter element on the hair dryer is equipped with contact slots and/or contact pins at its downstream end in the direction of the additional implement. This ensures good accessibility of the contacts when an implement is seated on the downstream end of the hair dryer.

The contact slots and/or contact pins on the slide switch of the implement are provided in upstream direction, so that these advantageously cooperate with those of the corresponding adapter element on the hair dryer when the switch is slid onto the housing of the other adapter element.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summary in the claims and their back-reference.

IN THE DRAWINGS

Figure 1:
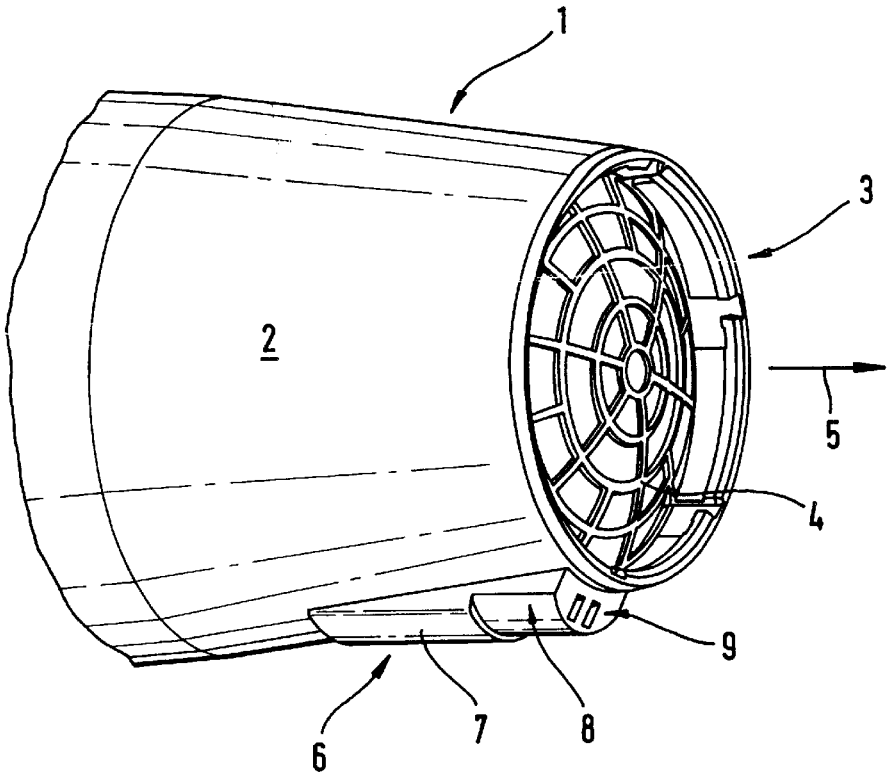
FIG. 1 is a perspective view of the air outlet end of a hair dryer with an adapter element.

The air outlet end of a hair dryer 1 (FIG. 1) is substantially comprised of a heater tube 2 with an air outlet port 3 in which an air outlet screen 4 is inserted. An air stream flows through this heater tube in the direction of main flow 5. Provided on the underside of the heater tube 2 in the proximity of the air outlet port 3 is an adapter element 6. This adapter element comprises on its outside a housing 7 with an individually formed housing section 8 provided on the forward air outlet end of the element 6. Two contact slots 9 for connection with a further adapter element are arranged at the end face of the element 6.

The adapter element 6 (FIGS. 2 and 3) comprises the housing 7 described in the foregoing and the contact rails 10 and contact terminals 11 arranged in the housing. In this arrangement, two contact rails 10 have equidistant apertures 13 and a contact tab 14 at their forward end in the proximity of the air outlet port 3 of the hair dryer. The contact terminals 11 have at their one end a scissors-type blade tap 15 and at their other end a contact tab 16.

Each two contact rails 10 are mounted on the outside of the heater tube 2 in parallel arrangement to each other, for example, by means of detent hooks engaging with a snap action into corresponding openings in the heater tube. Provided between the two contact rails 10 is a slotted opening 17 into which the two blade taps of the contact terminal 11 are slid. The contact tabs 16 of the terminals 11 point in opposite directions and are inserted into the apertures 13 of the rails 10, being thus electrically connected therewith. The contact rails 10 and the contact terminals 11 are fabricated from an electrically conducting material, while the heater tube 2 and the housing 7 of the adapter element 6 are made of an electrically insulating material, for example, plastic.

Figure 4:
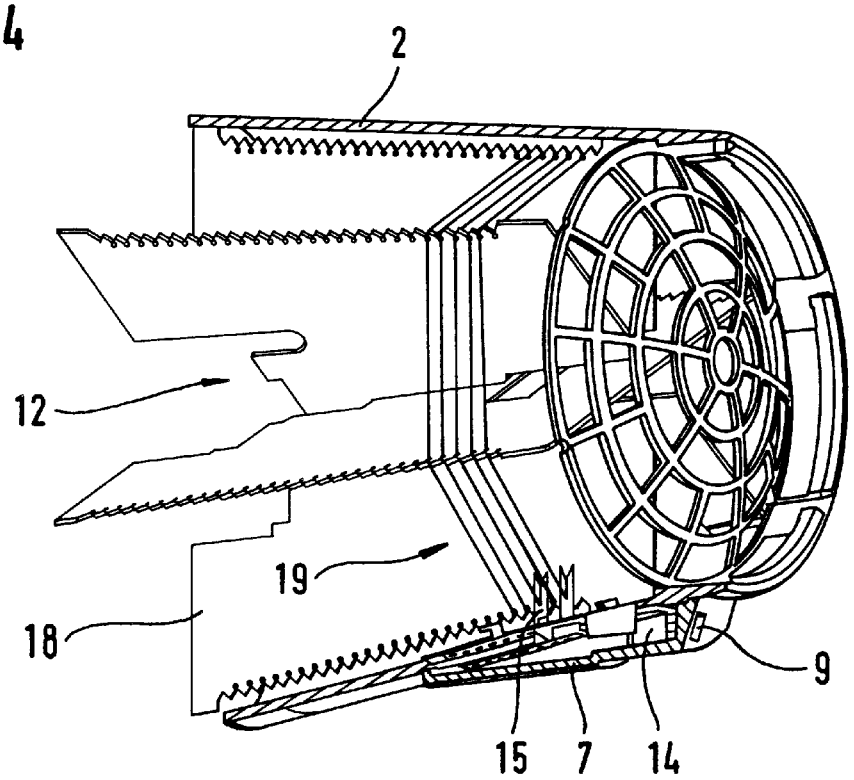
FIG. 4 is a partial sectional view of the air outlet end of the hair dryer of FIG. 1.

Received in the heater tube 2 (FIG. 4) is a heater unit 12 which is comprised of several heating conductor supports 18 and an electric resistance wire 19 wound around the supports. The distance between the individual turns of the electric resistance wire 19 corresponds to the distance between the apertures 13 in the contact rail 10. The length of the contact rail 10 is selected such as to correspond to the maximum distance from the first to the last turn of the electric resistance wire 19. This has the advantage of enabling the contact terminals 11 to be passed from outside through the slotted opening 17 of the heater tube 2 and to be seated onto a turn of the electric resistance wire 19 for electrical connection therewith. By means of the contact tabs 16 of the terminals 11, an electrical connection is established between the blade tap 15 and the contact rail 10. The contact rail 10 terminates at its end face in a contact tab 14 which is electrically connectable with a further adapter element through the contact slots 9 of the housing 7.

Figure 5:
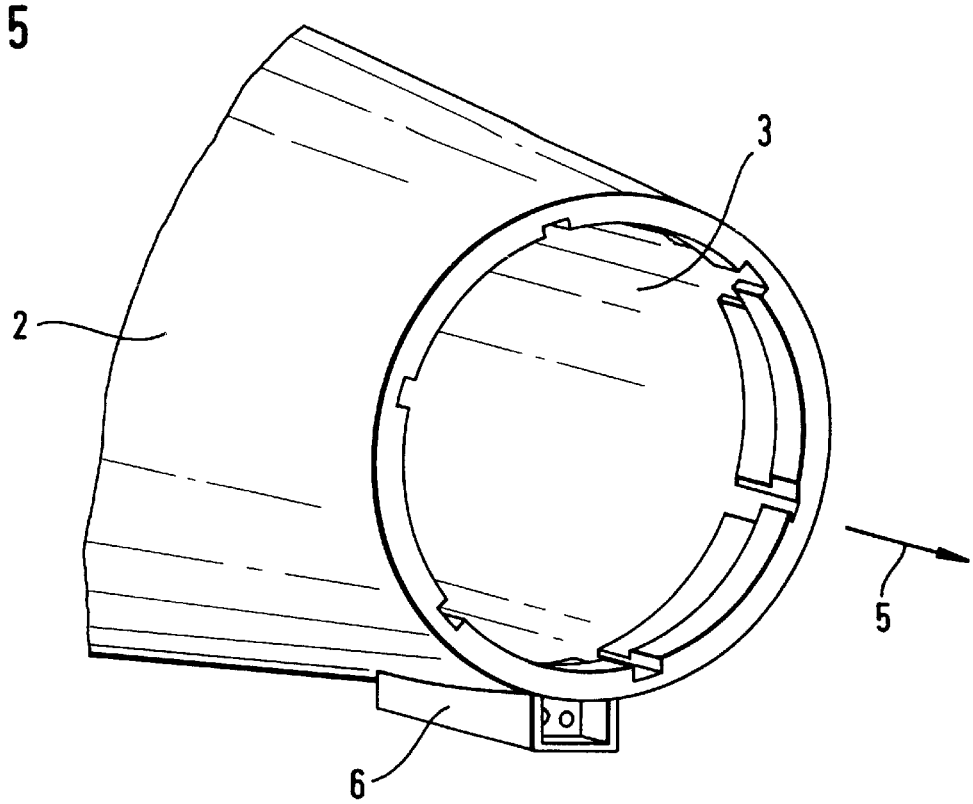
FIG. 5 is a perspective and schematic view of a heater tube for a hair dryer with an adapter element arranged on the outside thereof.

As shown, for example, in the preceding Figures, an adapter element 6 of the present invention (FIG. 5) may be provided on the outside of the heater tube 2. In such an arrangement, the forward end of the adapter element 6 terminates approximately flush with the air outlet port 3 of the heater tube 2 through which air is adapted to flow in the flow direction 5.

Figure 6:
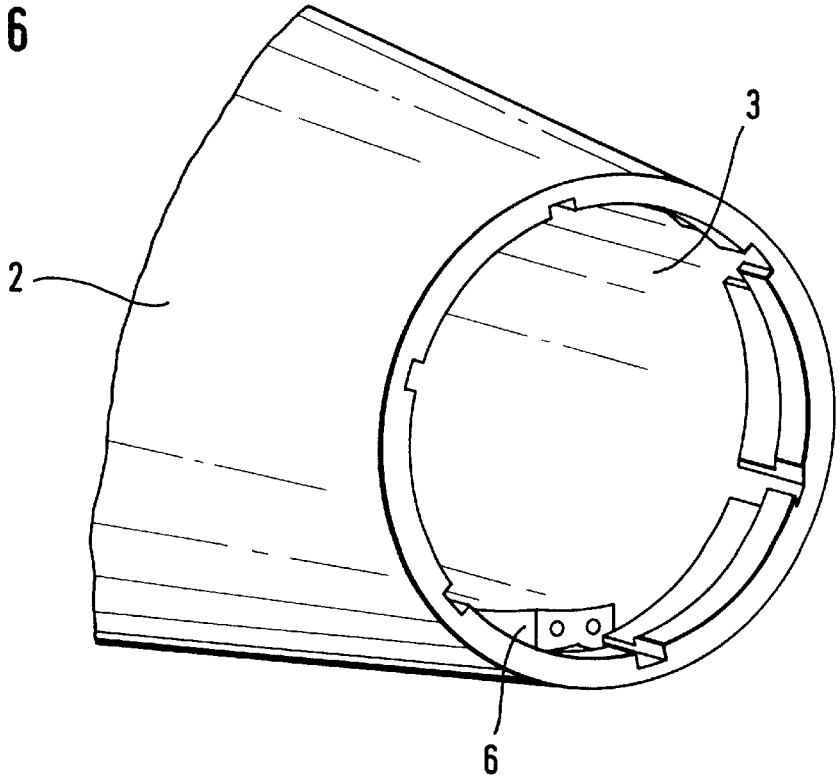
FIG. 6 is a view of a heater tube of FIG. 5 with an adapter element arranged on the inside thereof.
Figure 11:
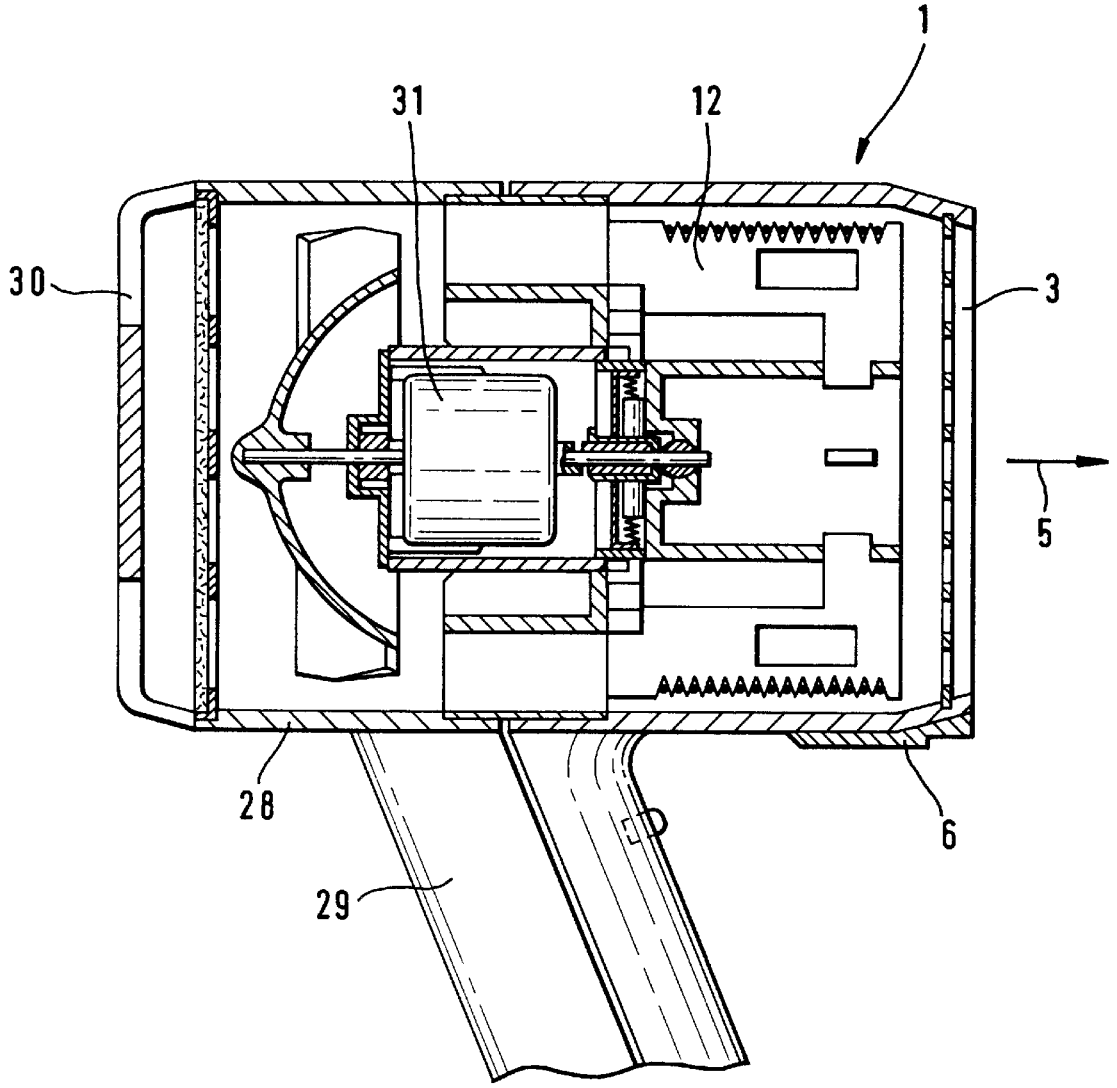
FIG. 11 is a schematic and sectional view of a hair dryer.

As an alternative to the above-described embodiment, it is however also possible for the adapter element 6 to be provided on the inside of the heater tube 2 and to terminate essentially flush with the air outlet port 3. In both embodiments of FIG. 5 and FIG. 6 it is also possible for the heater tube 2 to be enclosed from outside by an additional housing of the hair dryer (28, see FIG. 11).

Figure 7:
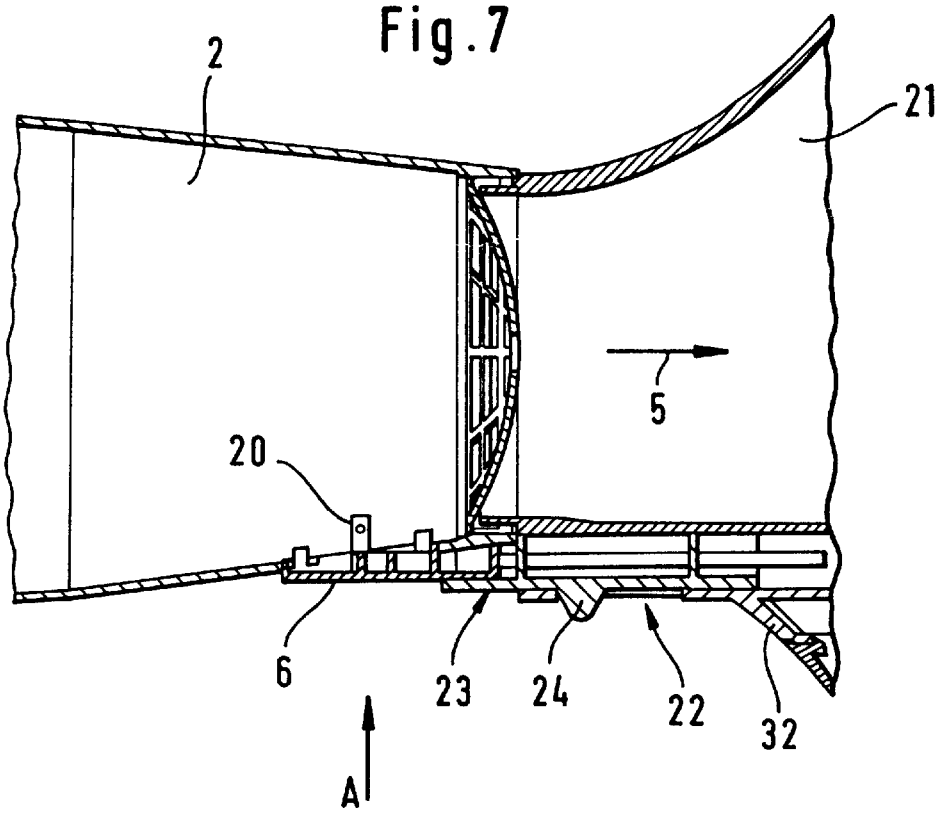
FIG. 7 is a schematic and sectional view of an air outlet end of a hair dryer with an air inlet end of an implement and adapter elements.

Two adapter elements 6 and 22 are provided at the junction (FIG. 7) between the air outlet end of a heater tube 2 of a hair dryer and the air inlet end of an implement 21. The adapter element 6 which is disposed at the air outlet end of the heater tube 2 corresponds substantially to the adapter element 6 previously described. However, a contact tab 20 extends from the adapter element 6 into the interior of the heater tube 2, enabling this contact tab 20 to be connected also to a voltage-carrying part of the hair dryer other than the heater unit 12 previously described. The adapter element 22 is fitted to the underside of the housing of the implement 21 and is equipped with a slide switch 23. This switch is slidable in a direction essentially parallel to the direction of main flow 5.

Figure 8:
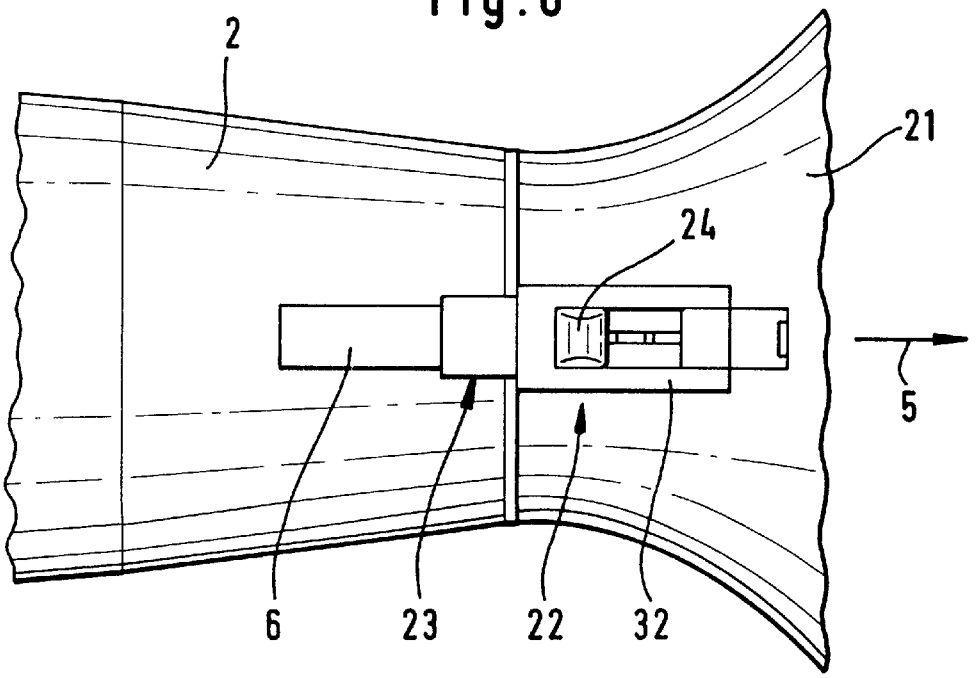
FIG. 8 is a view of a hair dryer and an implement as seen looking in the direction A of FIG. 7.

The slide switch 23 (FIG. 8) has a button 24 which is passed through an opening in the housing 32 of the adapter element 22. On seating engagement of the implement 21 with the air outlet port of the heater tube 2, the slide switch 23 is slidable in the direction of the adapter element 6 in opposition to the direction of main flow 5. This enables a mechanical connection to be established between the adapter element 22 and the adapter element 6. An implement 21 which is adapted to be seated and turned on the air outlet port of the heater tube 2, as by means of a bayonet catch, is thus mechanically protected by the slide switch 23 against disengagement by its own accord.

Figure 9:
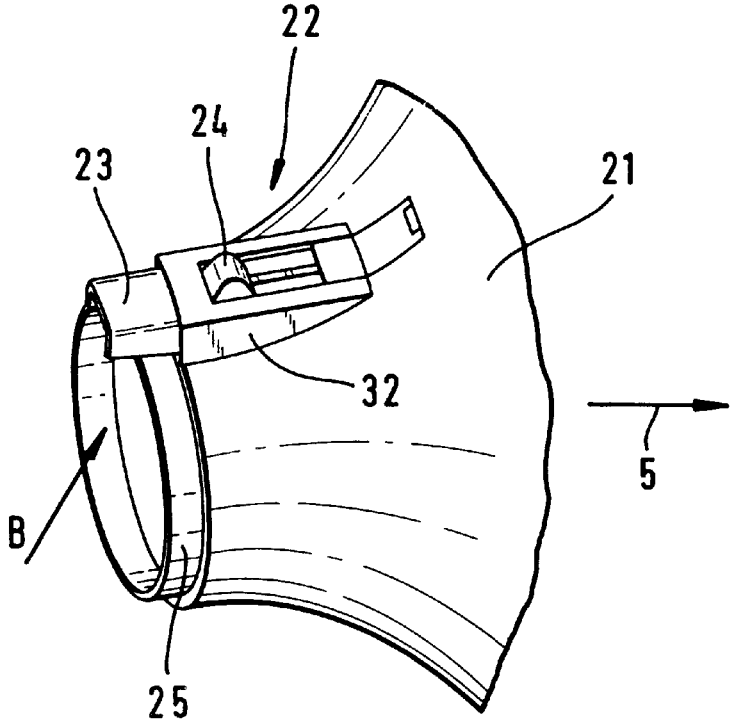
FIG. 9 is a perspective view of an air inlet end of an implement of FIG. 8.

The air inlet end of an implement 21 (FIG. 9) is comprised of an annular neck 25 adapted to be push-fitted onto the air outlet end of the heater tube 2. Adjoining this neck 25 in the direction of flow 5 is the casing of the implement 21 which is, for example, of a bell-shaped configuration. The housing 32 of the adapter element 22 is arranged at the junction between the neck 25 and the casing of the implement 21. In this arrangement, the slide switch 23 is configured such as to protrude beyond the forward edge of the neck 25 in extended position.

Figure 10:
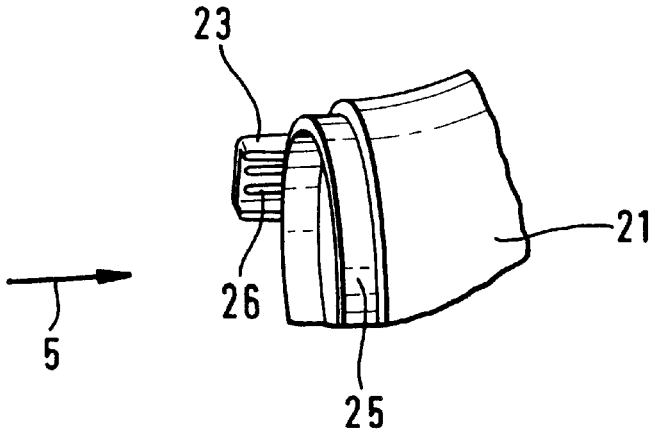
FIG. 10 is a perspective and fragmentary view of a slide switch as seen looking in the direction B of FIG. 9.

The slide switch 23 (FIG. 10) is of substantially U-shaped cross-section. Provided in the open interior of the switch 23 are contact pins 26 which can be connected electrically with the contact slots of a corresponding adapter element. In this arrangement, the contact pins 26 are arranged essentially parallel to the direction of main flow 5 of the hair dryer and the implement 21.

A hair dryer 1 (FIG. 11) which is able to accommodate an implement of the type described in the foregoing is substantially comprised of a housing 28 with a handle 29. Received in the housing 28 are a heater unit 12 and a fan motor 31. Ambient air is aspirated into the housing 28 through the air inlet port 30, exiting the housing again in the direction of main flow 5 at the air outlet port 3. Provided on the underside of the housing 28 is an adapter element 6 which is connectable with an implement, not shown, of the type described above.

Figure 2:
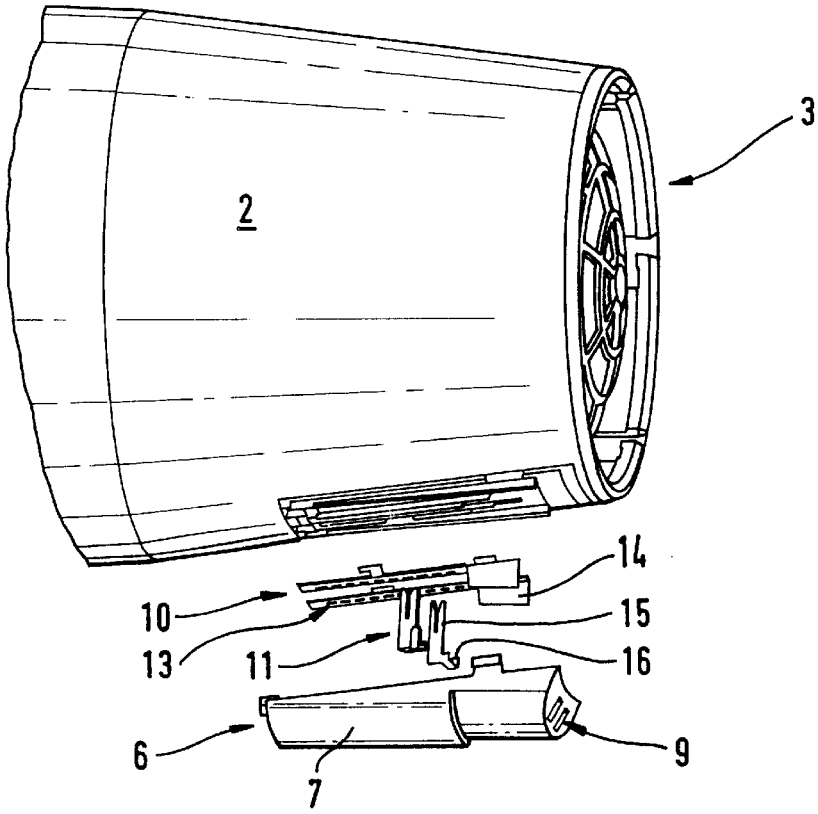
FIG. 2 is a view of the air outlet end of a hair dryer of FIG. 1 with an adapter element in exploded representation.
Figure 3:
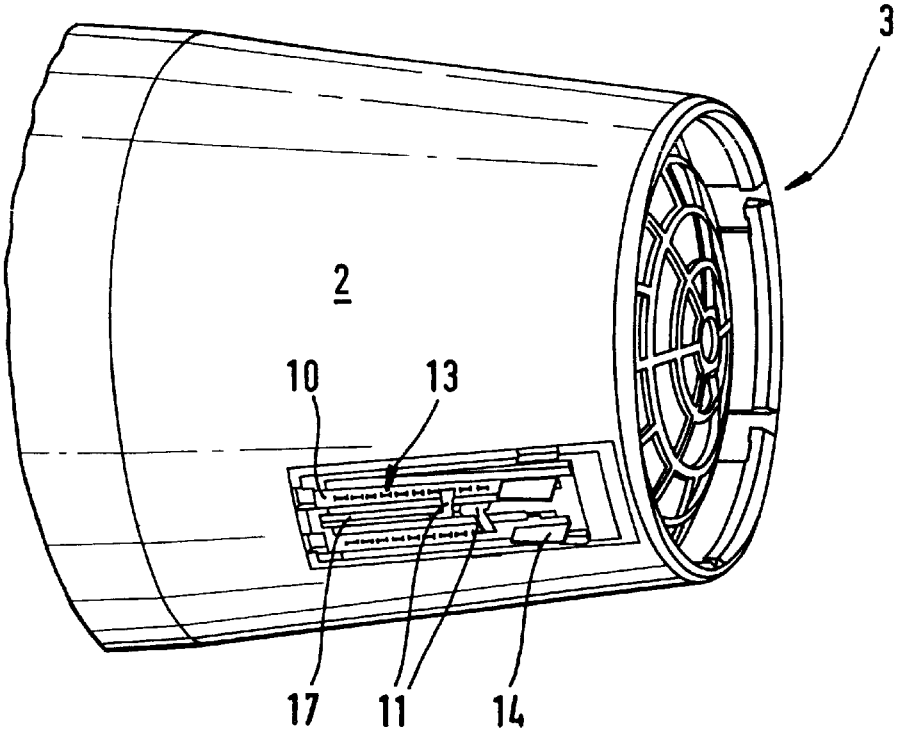
FIG. 3 is a view of the air outlet end of the hair dryer of FIG. 1 with an adapter element without its housing.
Figure 12:
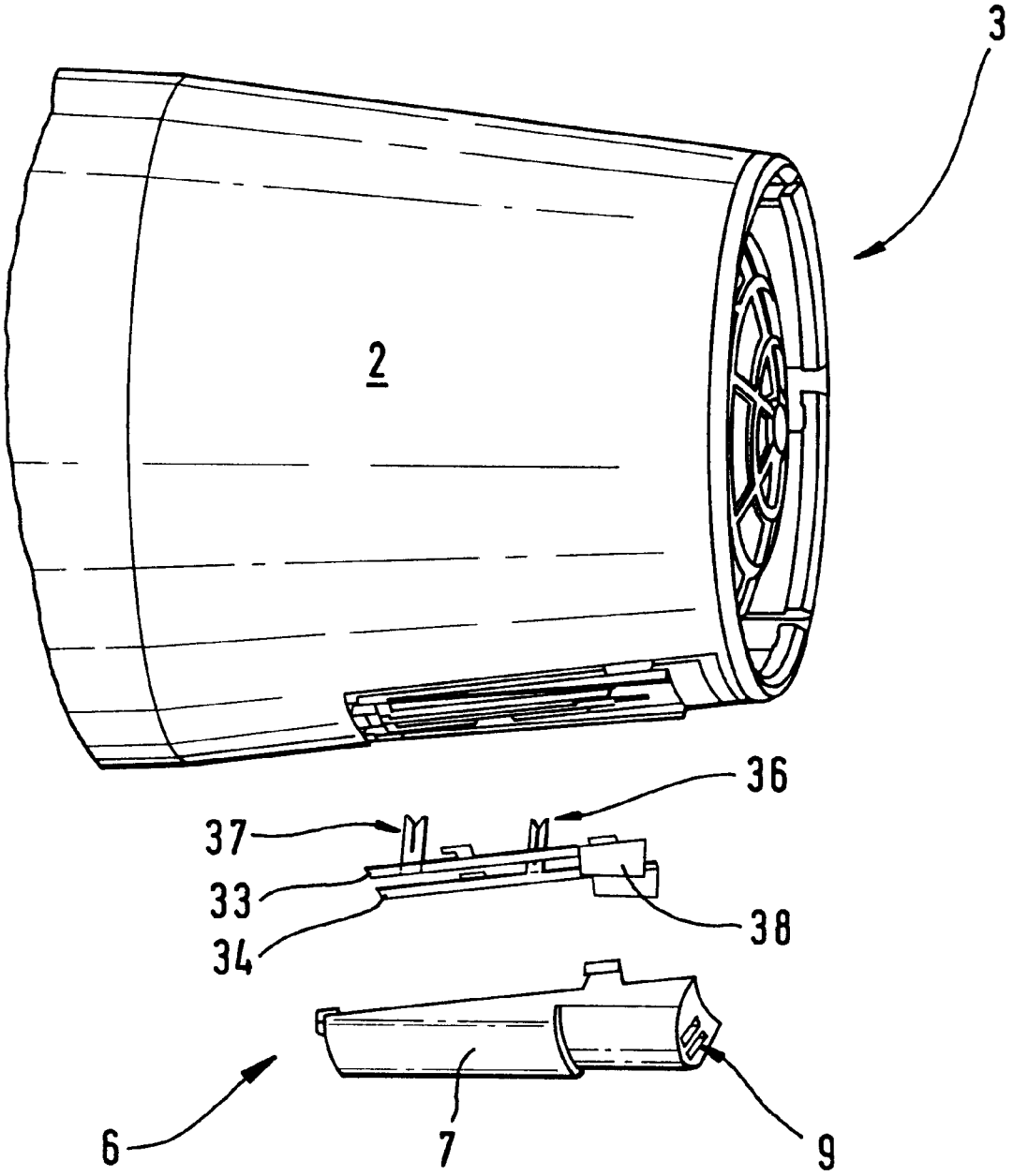
FIG. 12 is a view of the air outlet end of a hair dryer similar to FIG. 2 but with an integrally formed rail with contact terminal in exploded representation.

The adapter element 6 (FIG. 12) comprises the same components as described in the foregoing with reference to FIG. 2. Alternatively, however, the rails 33 and 34 are integrally formed with a contact terminal 36 and 37, respectively. In this embodiment, the contact terminals 36 and 37 are provided at different locations on the two rails 33 and 34, enabling an electric voltage value to be adjusted by means of the axial distance between the two contact terminals 36 and 37. A respective contact tab 38 is provided at the air outlet end of the rails 33, 34 for connection to a contact means of the additional implement. For assembly, the rails 33 and 34 are first inserted in the housing 7 and then mounted together with the housing on the outer shell of the heater tube 2 with a snap action.

We claim:

1. A hair treatment apparatus comprising, in combination, an electrically powered device for the treatment of hair and an electrically powered implement for the treatment of hair connectable to said electrically powered device and receiving electric power from said device, wherein the electrically powered device comprises a first adapter having a first electrical connector and a first geometric differentiating member having a first differentiating surface in a spaced adjacent relation to the first electrical connector, and the electrically powered implement comprises a second adapter engageable with the first adapter, the second adapter having a second electrical connector engageable with the first connector and a second geometric differentiating member having a second differentiating surface conforming to the first differentiating surface and disposed in approximately said spaced adjacent relation to the second electrical connector, wherein the second electrical connector cooperates with the first electrical connector when the second differentiating surface is in mechanical register with the first differentiating surface, whereby the implement and device are in mechanical and electrical operative association only when the first and second electrical connectors and the first and second differentiating surfaces are in register.

2. The apparatus of claim 1, wherein the first adapter further comprises at least one electrical conductor in electrical association with a source of power for electrically powering the electrically powered device, and the first geometric differentiating member comprises a housing surrounding the first electrical connector, the housing defining a first cross-sectional profile region and a second cross-sectional profile region different from the first cross-sectional profile region, said second cross-sectional profile region forming said first differentiating surface.

3. The apparatus of claim 1, wherein the device for the treatment of hair comprises an air-moving hair dryer having a housing defining an air passageway having an air inlet and an air outlet and having a fan motor and a heater in operative association therewith.

4. The apparatus of claim 3, wherein the electrically powered implement is attachable to the air outlet of the hair dryer and further comprises an electric load.

5. The apparatus of claim 1, wherein the first electrical connector comprises one of a plug element and a corresponding socket element, and the second electrical connector comprises the other of the plug element and the corresponding socket element.

6. The apparatus of claim 3, wherein the first adapter is formed on an inside surface of the hair dryer housing.

7. The apparatus of claim 3, wherein the first adapter is formed on an outside surface of the hair dryer housing.

8. The apparatus of claim 3, wherein the first geometric differentiating member further comprises a capsule housing substantially surrounding the first electrical connector and defining the first differentiating surface, said capsule being disposed on the housing of the hair dryer extending generally parallel to a longitudinal axis, said longitudinal axis drawn parallel to the air passageway and normal to the air outlet.

9. The apparatus of claim 3, wherein the first geometric differentiating member further comprises a capsule housing substantially surrounding the first electrical connector and defining the first differentiating surface, said capsule being formed separately from the housing of the hair dryer and having an interfitting retention means for assembly to the hair dryer housing.

10. The apparatus of claim 1, wherein the first geometric differentiating member further comprises a first capsule housing substantially surrounding the first electrical connector and defining the first differentiating surface, the second geometric differentiating member further comprises a second capsule housing substantially surrounding the second electrical connector and defining the second differentiating surface, and wherein the first and second capsule housings have guiding surfaces on their respective longitudinal sides.

11. The apparatus of claim 1, wherein the first geometric differentiating member comprises a first capsule surrounding the first electrical connector and having a peripheral region of generally constant cross-sectional profile forming said first differentiating surface, and the second geometric differentiating member comprises a second capsule surrounding the second electrical connector and having a peripheral region of generally constant cross-sectional profile corresponding to the cross-sectional profile region of the first capsule and forming said second differentiating surface.

12. The apparatus of claim 1, wherein the first geometric differentiating member comprises a first capsule housing surrounding the first electrical connector and forming said first differentiating surface, the second geometric differentiating member comprises a second capsule housing surrounding the second electrical connector and forming said second differentiating surface, and one of the first and second capsule housings further comprises a switch slidably disposed in the housing and slidable onto the other of the first and second capsule housings when the implement and the device are in operative association.

13. The apparatus of claim 12, wherein the switch is slidable in a direction parallel to a longitudinal axis through the device and the implement in the connected condition.

14. The apparatus of claim 3, wherein the first adapter further comprises a housing defining the first geometric differentiating member, the housing having a peripheral polygonal contour of closed cross-sectional area.

15. The apparatus of claim 12, wherein the slidable switch has a U-shaped cross-section.

16. The apparatus of claim 12, wherein the slidable switch is disposed on the electrically powered implement in the second capsule housing.

17. The apparatus of claim 1, wherein the first geometric differentiating member of the first adapter further comprises at least one electrical contact in conductive relation with the first electrical connector, said at least one electrical contact being chosen from the group of contacts consisting of slots and pins.

18. The apparatus of claim 17, wherein the second geometric differentiating member comprises a housing surrounding the second electrical connector and forming said second differentiating surface, and a switch slidably disposed in the housing and slidable onto the first differentiating surface when the implement and the device are in operative association, wherein the slidable switch comprises at least one electrical contact shaped to cooperate with the at least one electrical contact of the first adapter.

* * * * *